US011078896B2

(12) United States Patent
Lynn et al.

(10) Patent No.: US 11,078,896 B2
(45) Date of Patent: Aug. 3, 2021

(54) ROLL DIAPHRAGM COMPRESSOR AND LOW-PRESSURE VAPOR COMPRESSION CYCLES

(71) Applicant: Treau, Inc., San Francisco, CA (US)

(72) Inventors: Peter Sturt Lynn, Alameda, CA (US); Vincent Domenic Romanin, San Francisco, CA (US); Adrien Benusiglio, San Francisco, CA (US); Saul Thomas Griffith, San Francisco, CA (US)

(73) Assignee: Treau, Inc., San Francisco, CA (US)

( * ) Notice: Subject to any disclaimer, the term of this patent is extended or adjusted under 35 U.S.C. 154(b) by 32 days.

(21) Appl. No.: 16/289,440

(22) Filed: Feb. 28, 2019

(65) Prior Publication Data

US 2019/0264673 A1 Aug. 29, 2019

Related U.S. Application Data

(60) Provisional application No. 62/636,733, filed on Feb. 28, 2018.

(51) Int. Cl.
*F04B 39/12* (2006.01)
*F04B 45/047* (2006.01)
(Continued)

(52) U.S. Cl.
CPC ..... *F04B 39/125* (2013.01); *F04B 45/047* (2013.01); *F04B 53/006* (2013.01);
(Continued)

(58) Field of Classification Search
CPC .... F04B 45/041; F04B 45/047; F04B 53/006; F04B 53/16; F04B 2205/03;
(Continued)

(56) References Cited

U.S. PATENT DOCUMENTS 4,688,397 A * 8/1987 Bakay ..... F25B 9/006 62/335
5,785,508 A * 7/1998 Bolt ..... F04B 39/1073 137/855

(Continued)

FOREIGN PATENT DOCUMENTS

WO 1992015774 9/1992

OTHER PUBLICATIONS

Research Hub; Nonlinear System VS Linear System, 2015, http://researchhubs.com/post/maths/fundamentals/bell-shaped-function.html (Year: 2015).*

(Continued)

*Primary Examiner* — Steve S Tanenbaum
(74) *Attorney, Agent, or Firm* — Davis Wright Tremaine LLP

(57) ABSTRACT

A roll-diaphragm compressor that includes a compressor head with an interface wall that defines a concave portion and with an apex portion having an inlet port and outlet port. The roll-diaphragm compressor can also include a flexible roll-diaphragm coupled to the compressor head about an edge with the roll-diaphragm driven in a rolling motion against the interface wall. The roll-diaphragm compressor can also include a compression chamber defined by the compressor head and roll-diaphragm that is configured for receiving a fluid via the inlet port in a first state, compressing the fluid based on the volume of the compression chamber being made smaller, and expelling the fluid in a second state via the outlet port.

16 Claims, 7 Drawing Sheets

(51) Int. Cl.
*F04B 53/00* (2006.01)
*F04B 53/16* (2006.01)

(52) U.S. Cl.
CPC ..... *F04B 53/16* (2013.01); *F04B 2205/03* (2013.01); *F05B 2280/4004* (2013.01); *F05B 2280/5001* (2013.01); *F05B 2280/6003* (2013.01); *F05B 2280/6013* (2013.01)

(58) Field of Classification Search
CPC .... F04B 43/0063; F04B 39/125; F04B 45/04; F05B 2280/6003; F05B 2280/5001; F05B 2280/4004; F05B 2280/6013; F25B 6/02; F25B 6/00; F25B 7/00; F25B 2400/061; F25B 2400/06; F25B 2400/075; F25B 2400/0751
USPC ..... 62/510
See application file for complete search history.

(56) References Cited

U.S. PATENT DOCUMENTS

2005/0274130 A1* 12/2005 Chen ..... F25B 1/00 62/100
2008/0181800 A1* 7/2008 Muschalek ..... F04B 45/04 417/470
2013/0213078 A1* 8/2013 Morimoto ..... F25B 40/02 62/324.6
2015/0285238 A1* 10/2015 Lynn ..... A61H 1/0277 417/53

OTHER PUBLICATIONS

International Search Report and Written Opinion, dated May 23, 2019, International Patent Application No. PCT/US2019/020131, filed Feb. 28, 2019, 7 pages.

* cited by examiner

ROLL DIAPHRAGM COMPRESSOR AND LOW-PRESSURE VAPOR COMPRESSION CYCLES

CROSS-REFERENCE TO RELATED APPLICATIONS

This application is a non-provisional of and claims the benefit of U.S. Provisional Application No. 62/636,733, filed Feb. 28, 2018, which application is hereby incorporated herein by reference in its entirety and for all purposes.

Figure 1:
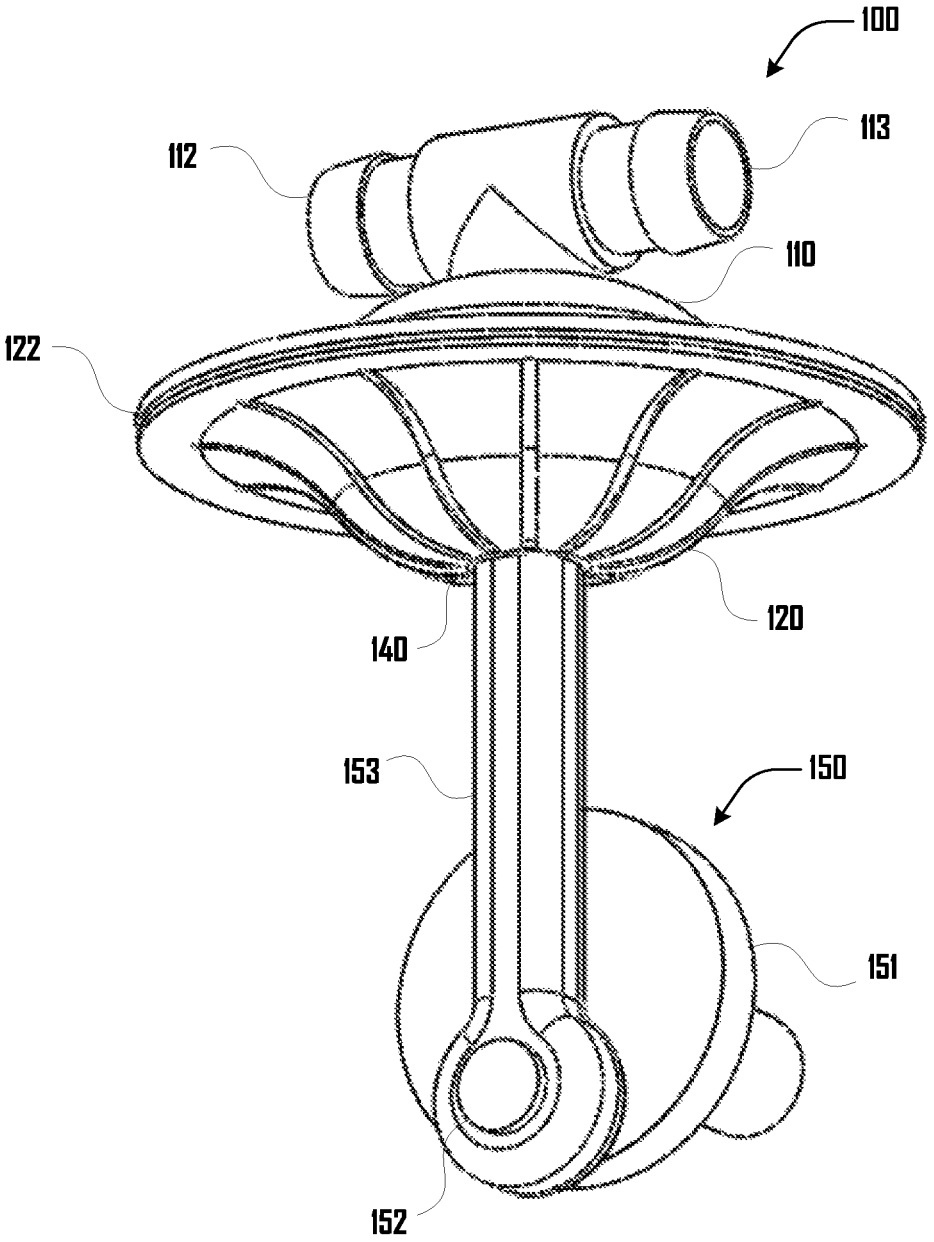
FIG. 1 illustrates a roll diaphragm compressor in accordance with one example embodiment.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Compressors can be part of many thermodynamic systems, including vapor compression cycles (see e.g., FIG. 4), which can power cooling and refrigeration and heating systems. In these systems, work or electricity can be used to move heat from a cold environment into a hot environment, which in turn makes the cold environment colder and the hot environment hotter. This can be accomplished with a vapor compression cycle, where a substance is converted from a liquid to a gas (evaporated), which can require the addition of heat. The substance can then be compressed in a compressor, which increases both its pressure and temperature and the substance can then be converted from a gas to a liquid (condensed) which can require the removal of heat (e.g., at a higher temperature than at which the heat was added). Finally, the substance can be expanded, or reduced in pressure through an expansion valve or other suitable mechanism, which can both lower the pressure and lower the temperature.

Figure 4:
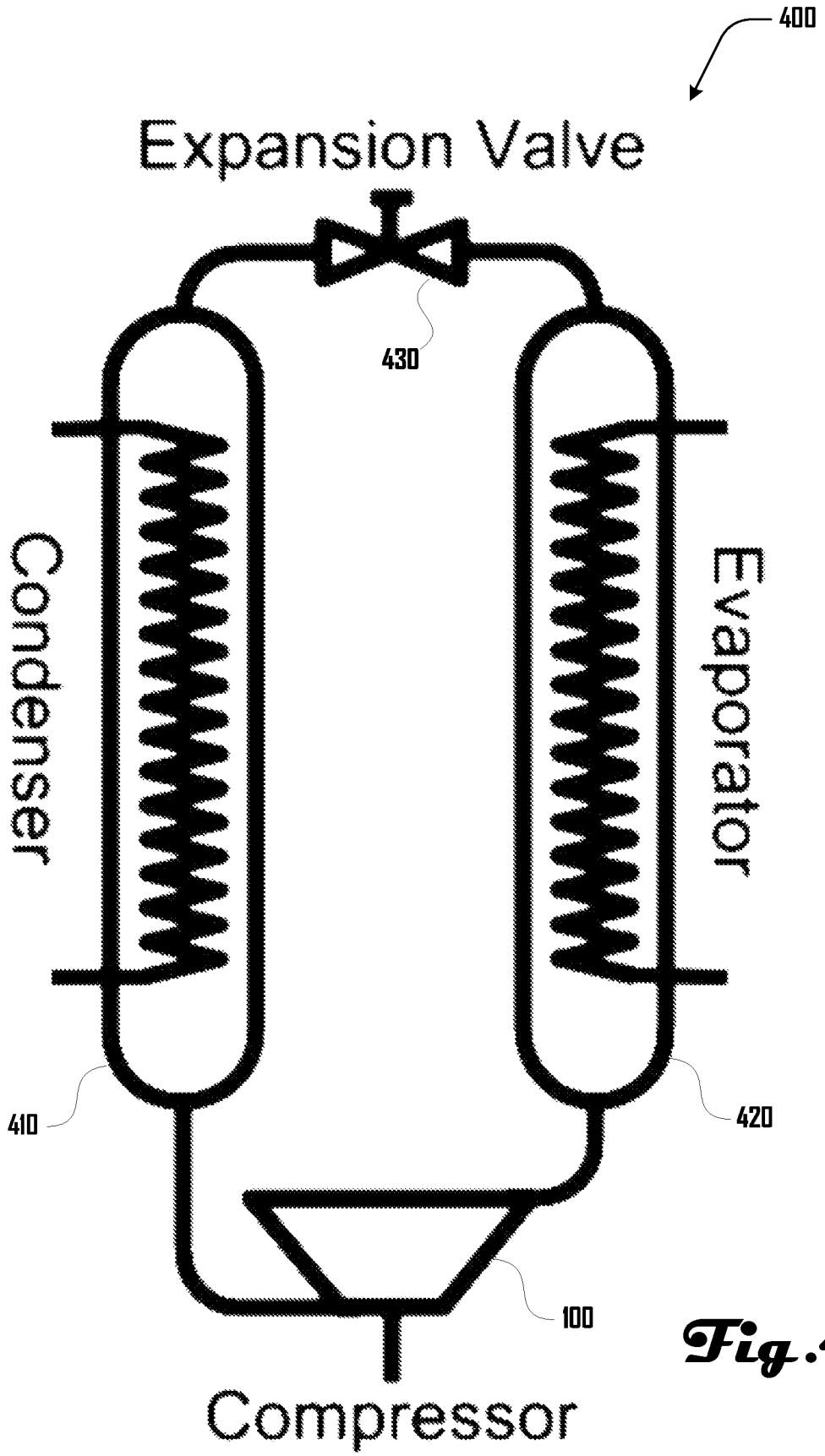
FIG. 4 illustrates components in an example vapor compression cycle.

For example, referring to the system 400 of FIG. 4, in some examples a refrigerant can flow through the compressor 100, which can raise the pressure of the refrigerant. The refrigerant at higher pressure from the compressor 100 can flow through the condenser 410, where the refrigerant can condense from vapor form to liquid form, giving off heat in the process. The refrigerant can then go through the expansion valve 430, where the refrigerant experiences a pressure drop. The refrigerant can then flow to the evaporator 420, where the refrigerant draws heat from the evaporator 420 which can cause the refrigerant to vaporize. The evaporator 420 can draw heat from a region that is to be cooled. The vaporized refrigerant can go back to the compressor 100 to restart the cycle.

This can be depicted via a temperature-entropy diagram (e.g., FIG. 3), as the properties of the fluid at any point in this process can be completely known if any two independent properties are known, and temperature and entropy are two independent properties.

In some embodiments, the most costly and performance-critical component of such a process can be the compressor. The compressor can serve to increase the pressure of the gas as efficiently as possible in some embodiments. In various examples, the compressor does this with an inlet valve, a compression chamber that changes volume along the compression stroke, and an exit valve.

Several problems can exist with compressors. First, compressor technologies used in vapor compression cycles can require lubricants and can have metal sliding or rolling seals which contain the fluid being compressed, which can be undesirable in some implementations. Such lubricants can include Polyolester (POE) and Polyvinyl Ether oil (PVE), or other oils. POE oils are hygroscopic, meaning they have a tendency to absorb moisture, and any moisture can combine with the oil to create acid, which can corrode components in the system. PVE oils are not hygroscopic, but they are slightly toxic. If lubricant is lost for any reason, these sliding metal surfaces can wear or seize, causing the compressor to fail.

Second, compressor technologies used in vapor compression cycles often cannot reliably accept liquid/gas mixtures, only pure gases. This means that in some examples the cycle must be designed to operate such that the inlet to the compressor does not contain any liquid droplets. The reason a compressor in various examples cannot accept any liquid/gas mixtures can be because of failure methods including: the liquid can wash away the lubricants causing wear or seizing and/or a pool of liquid which is not compressible can cause the compression chamber to experience undesirably large forces when the compressor tries to compress an incompressible fluid, which can damage components of the compressor.

Finally, some compressor technologies can have relatively small displacement volumes, or total inlet compression chamber volumes, for their total physical size. This can be because in some examples the compression chamber itself must have one sliding surface that moves in a rigid chamber, and such mechanisms and structure tend to not be space-efficient in various example. The result is that, in some examples, when the motor drive is included, the volume of the compressor can be much larger than the volume of the compression chamber.

One problem that can arise from the lack of capabilities of some compressors is that the selection of the fluid used in a vapor compression cycle, or the "refrigerant," must be compatible with the displacement and lubricant used in a compressor. Various refrigerants can be harmful for the environment. A compressor that does not need lubricants and has a larger displacement would enable, in some embodiments, alternative fluids as refrigerants in vapor compression cycles that are more environmentally friendly, lower cost, and more efficient.

A compressor that is more space-efficient, that does not use lubricants (e.g., oil-based or synthetic lubricants), and that is compatible with small amounts of liquid in liquid-gas mixtures can increase the capabilities and reliability of vapor compression cycles in various embodiments. For example, FIG. 3*b* shows a temperature-entropy diagram where the fluid entering the compressor is a liquid/gas mixture that is 8% liquid by mass, which can result in a saturated vapor at the exit of compression.

In various embodiments as discussed herein, reference to a "roll diaphragm," and/or "roll-sock/diaphragm hybrid" should not be construed to mean a roll-sock with diaphragm-like mounting flanges. A roll diaphragm of various embodiments departs significantly from an arc profile shape, assuming more of a bell shape where the rolling section spans a large proportion of the total radius. In some embodiments, a "roll diaphragm," and/or "roll-sock/diaphragm hybrid" can be differentiated from a roll sock or diaphragm. Accordingly, in various embodiments, one or more of the following can define a roll diaphragm and/or roll-sock/diaphragm hybrid:

The roll diaphragm structurally performs in tension, (e.g., like a roll sock) but not bending, like a diaphragm;

The roll diaphragm is capable of much greater displacement than a diaphragm, because in some embodiments the roll diaphragm operates in tension and not in bending, and so is capable of deforming by a much larger amount;

The roll diaphragm is capable of much greater pressure than a diaphragm because in some embodiments, while a diaphragm must support the pressure of the compression chamber in bending, a roll diaphragm can support the pressure of the compression chamber in tension, and the tensile strength of the diaphragm can be comparably high due to fiber reinforcement;

The roll diaphragm makes direct rolling contact with surrounding walls of the compressor, which can eliminate or substantially reduce dead volume within the compressor;

The curvature of a roll diaphragm is the inverse of a diaphragm (e.g., a balloon not a deflecting plate);

The roll diaphragm, like a roll sock, comprises tensile reinforcement (e.g., reinforcing fibers/elements);

The roll diaphragm, unlike a roll sock, does not operate between cylindrical walls—the constraining walls vary both axially and radially and have significant curvature (e.g., they can be bell-shaped); and Unlike a roll sock, the radius of curvature of the roll diaphragm is a significant proportion of the diameter of the roll diaphragm, which can enable much higher wall thickness and higher fatigue life. For example, in the configuration shown in FIG. 2*b*, the radius of curvature of the roll diaphragm is approximately one half of the radius of the roll diaphragm.

In some embodiments, a refrigerant can comprise water or alcohols (e.g. methanol, ethanol, glycol), or mixtures of any of such compounds. These refrigerants may not be compatible with some lubricants, and such refrigerants can be more efficient in some examples if the inlet to the compressor is a mixture of gas and liquid. Some refrigerant mixtures can require operation at sub-atmospheric pressures and high volumes in some examples. For example, the cycle depicted in FIG. 3*b* can operate with a low-side pressure of 1 psia and a high-side pressure of 5 psia, but in some examples, can require volumetric flow rates that are much higher (e.g., 10× higher or more) than cooling cycles with standard refrigerants under the same power conditions. Many cooling cycles with standard refrigerants operate with pressures between 100 psia and 300 psia. However, various suitable refrigerant mixtures can be environmentally friendly, low cost, and can be very efficient in various embodiments.

Turning to FIGS. 1 and 2*a-d*, a roll-diaphragm compressor 100 can comprise a rigid compressor head 110 and a flexible roll-diaphragm 120 that define a compression chamber 130. The roll-diaphragm 120 can be driven by a piston head 140 that moves to change the volume of the compression chamber 130 as described in detail herein.

The compressor head 110 defines a concave portion 117 that includes a bell-shaped interface wall 111 that defines a portion of the compression chamber 130 along with the roll-diaphragm 120. The compressor head 110 further comprises an apex portion 116 that includes an inlet port 112 and outlet port 113, with a one-way inlet valve 114 and a one-way outlet valve 115 associated with the inlet port 112 and outlet port 113 respectively. The roll-diaphragm 120 couples with the head 110 at an edge 122. The roll-diaphragm 120 also comprises a central portion 123 that is coupled to and driven by the piston head 140.

The compressor 100 further includes a crank assembly 150 that comprises a crank-wheel 151 with a pin 152 is coupled to the crank-wheel 151 and a piston shaft 153 are rotatably coupled to the pin 152 and to the roll-diaphragm 120. Accordingly, rotation of the crank-wheel 151 can drive the roll-diaphragm 120 as discussed herein.

Figure 2A:
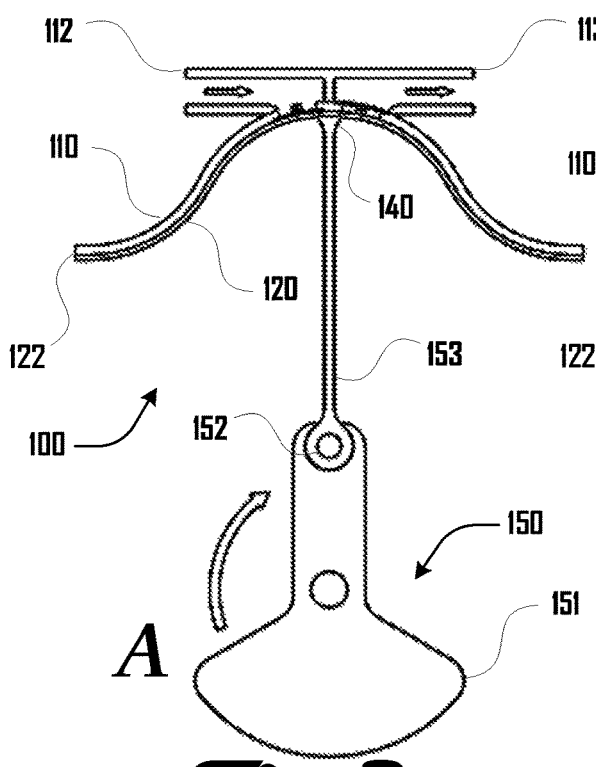
FIGS. 2*a*, 2*b*, 2*c* and 2*d* illustrate an example roll diaphragm compressor in operation in accordance with an embodiment including respective stages of a compression cycle.
Figure 2B:
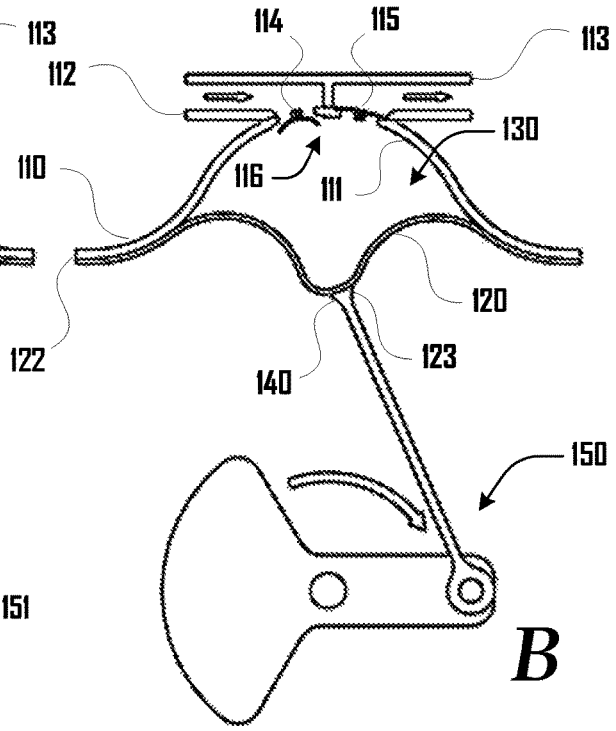
Figure 2C:
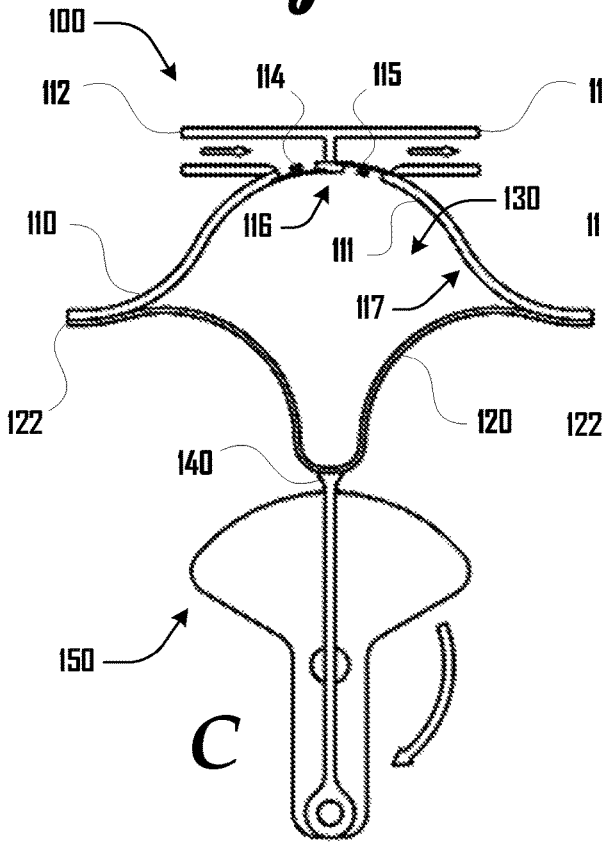
Figure 2D:
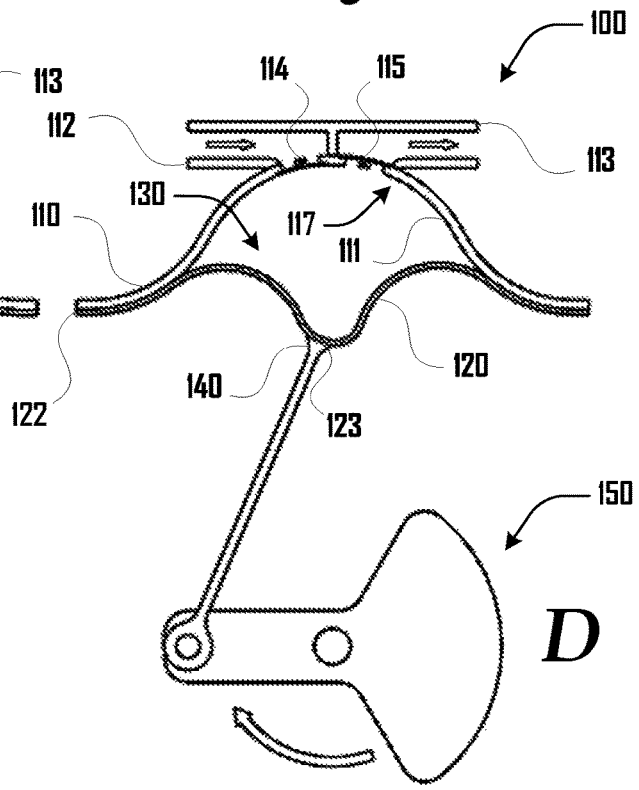

As illustrated in FIGS. 2*a-d* the roll-diaphragm compressor 100 can assume configurations A, B, C and D. FIG. 2*b* illustrates an intake stroke of the roll-diaphragm compressor 100 that includes moving from configuration A to B to C. FIG. 2*d* illustrates a discharge stroke of the roll-diaphragm compressor 100 that includes moving from configuration C to D to A.

As shown in FIG. 2*a*, the intake stroke begins with the diaphragm 120 engaging and/or nearly engaging the interface wall 111. The piston head 140 is in a fully extended position with the diaphragm central portion 123 engaging and/or nearly engaging the head 110 about inlet and outlet ports 112, 113. The compression chamber 130 is substantially absent or at its minimum.

The piston head 140 rolls away from the head 110 as shown in FIG. 2*b*, and the diaphragm 120 disengages from and move away from the interface wall 111. The compression chamber 130 increases in volume and can generate a vacuum or reduced pressure in the compression chamber 130, which draws fluid in from the inlet port 112 and opens the one-way inlet valve 114 so that the fluid is drawn into the compression chamber 130.

As shown in FIG. 2*c*, the piston head 140 continues away from the head 110 to a position where the compression chamber 130 is at its maximum volume and where the piston head 140 is at its maximum distance from the head 110. The increasing volume of the compression chamber 130 continues to draw fluid into the compression chamber 130 from the inlet port 112 through the one-way inlet valve 114.

Accordingly, as shown in FIGS. 2*a-c*, the roll-diaphragm compressor 100 can draw fluid into the compression chamber 130 by moving from configuration A to B to C, where the piston head 140 moves away from the head 110 such that the roll-diaphragm 120 disengages and moves away from the interface wall 111. The compression chamber 130 increases in volume and fluid is drawn into the compression chamber 130 through the inlet port 112 and via the open one-way inlet valve 114.

FIG. 2*d* illustrates a discharge stroke of the roll-diaphragm compressor 120 that includes moving from configuration C to D to A. As shown in FIG. 2*c*, the piston head 140 begins in a position where the compression chamber 130 is at its maximum volume and where the piston head 140 is at its maximum distance from the head 110. Fluid is at maximum capacity within the compression chamber 130 and one-way valves 114, 115 are closed.

As shown in FIG. 2*d*, the piston head 140 begins to rollably move toward the head 110, which generates positive pressure within the compression chamber 130. This positive pressure opens the one-way outlet valve 115 and allows fluid to leave the compression chamber 130 via the outlet port 113.

The piston head 140 continues toward the head 110 until the roll-diaphragm 120 engages and/or nearly engages the interface wall 111. The compression chamber 130 is at its minimum volume and all or nearly all of the fluid is expelled from the compression chamber 130 via the open one-way outlet valve 115 and through the outlet port 113.

Accordingly, the roll-diaphragm compressor 100 can expel fluid from the compression chamber 130 by moving from configuration C to D to A, where the piston head 140 moves toward the head 110 such that the roll-diaphragm 120 moves toward and engages the interface wall 111. The compression chamber 130 decreases in volume and fluid leaves the compression chamber 130 through the outlet port 113 and via the open one-way outlet valve 115. In contrast to conventional compressor systems, the present embodiment leave little if any dead space (i.e., volume remaining in the compression chamber 130 at the end of the discharge cycle), which can substantially improve compressor efficiency. In various embodiments, the flexible roll-diaphragm 120 pressing against the interface wall 111 provides the benefit of forcing all or nearly all of the fluid out of the compression chamber 130 during the discharge stroke.

In various embodiments, a bell-shaped rounded interface wall 111 as shown herein can be beneficial because it can minimize the dead volume in the compression chamber 130 to improve compression efficiency of the roll-diaphragm compressor 100 as discussed above. In other words, because the roll-diaphragm 120 can conform to and engage with the curvature of the interface wall 111 and the inlet and outlet ports 112, 113, as shown in configuration A (FIGS. 2*a* and 2*c*) the volume of the compression chamber 130 can be close to or nearly zero when the roll-diaphragm compressor 100 is in configuration A. This can be beneficial because all or nearly all of the fluid drawn into the compression chamber 130 is expelled during a compression cycle instead of a substantial amount of fluid remaining in the compression chamber 130, which decreases compressor efficiency.

Some embodiments can include a sub-atmospheric pressure compressor 100 that is high-displacement, has no sliding seals, and/or has no lubricants. For example, such a compressor can comprise a roll diaphragm 120 and a bell-shaped "cylinder" head 110. The roll diaphragm 120 can be fixed/sealed to a base or edge 122 of the bell-shaped "cylinder" head 110, with the head 110 and diaphragm 120 defining the compression chamber 130 in which fluid can be compressed (e.g., as shown in FIGS. 1 and 2*a-d*). This can be high-displacement because the amount of mass of material required to create the compression chamber can be small compared to standard piston and scroll cylinder heads, which can mean that the same cost of material can result in a larger compression volume. For a similar size and weight of compressor, the total compressor displacement can be twice as large or more in some examples.

In some examples, the roll diaphragm 120 can be pushed against the "cylinder" head 120 by the force of atmospheric pressure, which can largely eliminate dead volume in the compression chamber 130 various examples, and can then be pulled away from the "cylinder" head 110 with a tensile rod connected to a motor, which pulls the working fluid into the compression chamber 130.

Because the "cylinder" head 110 contains no sliding surfaces in some examples, the entirety of the head 110 can be available as a valved surface, whereas the cylinder walls of a piston compressor can be sliding surfaces and thus cannot be easily used as a valved surface. This means that the "cylinder" head 110 of various embodiments can support very large valves or multiple valves in comparison to a piston compressor of the same capacity of some embodiments. Based on dimensions of some common piston compressors, the increased area for valves in the "cylinder" head 110 can be three times greater. In some examples, valves can be flat so as to minimize dead volume, or volume available for gas when the compressor 130 is in its completely compressed, or minimum internal volume (e.g., configuration A of FIG. 2*a*).

In various embodiments, valve location is not constrained to the surface area of a cylinder head 110, which can enable twice larger valves in various examples. Larger valves can have larger flow cross-sectional area, which can mean one fourth lower flow losses and higher efficiency compression in some examples.

The roll diaphragm 120 can be made in various suitable ways and comprise various suitable materials. For example, the roll diaphragm can comprise multiple layers, including, protective layers, insulating layers, wear resistant layers, impermeable layers, and the like. In various example, the roll diaphragm 120 can comprise a fiber-reinforced elastomer, (e.g., as in automobile timing belts). For example, in some embodiments the roll diaphragm 120 can comprise an elastomer body (e.g., rubber) having fiber chords (e.g., Kevlar, polyester, or the like) embedded therein that serve to reinforce the elastomer body. Such fiber chords can be inextensible along a main axis such that the fiber is substantially rigid and strong along its length while being flexible in other direction to allow for rolling of the roll diaphragm 120 as discussed herein. Fiber-reinforced elastomers used for a roll diaphragm 120 can provide for longevity at reasonable cost. Similar to automotive timing belts, in various embodiments, a roll diaphragm 120 can have low hysteresis loss, (i.e., can have low deformation energy and/or efficient energy recovery of the energy used to deform the roll diaphragm).

In some embodiments, a roll diaphragm compressor 100 can only have moving seals at the valves 114, 115, which can be non-sliding. The seal between the roll diaphragm 120 and the compressor "cylinder" head 110 can be static, enabling hermetic sealing, meaning leakages and the associated losses can be minimized in various embodiments (unlike some examples of sliding piston ring seals). This can mean that loss of the fluid being compressed can be minimized in some examples, which can be desirable for high-value fluids being compressed such as hydrogen or refrigerants, and can also be desirable for fluids that are harmful to the environment or people, such as some toxic refrigerants or explosive fluids.

Sliding seals of some compressors are friction surfaces that can generate heat, which can be a loss of energy and a reduction of compressor efficiency. For example, piston compressors can have piston rings that slide against the piston cylinder. A roll diaphragm compressor 100 of various embodiments can have no such sliding surfaces, meaning friction losses can be minimized or eliminated in various embodiments.

In some pressurized cylinder piston arrangements, the connecting rod can be under compressive load and can require a pivot or bearing surface at the piston. For sub-atmospheric operation of a roll diaphragm compressor 100, in accordance with some embodiments, the connecting rod 153 can always be in tension and can be replaced by a low-mass tensile flexural element. In some examples, such an element can provide for flexing the roll diaphragm 120 itself to achieve angular motion, which can eliminate another source of friction, wear and maintenance.

In various examples, a roll diaphragm compressor 100 that does not use sliding seals does not need lubrication to maintain those sliding seals. This means that lubrication does not need to be compatible with, and will not contaminate, the working fluid being compressed by the roll diaphragm compressor 100 in such examples. Accordingly, various embodiments of a roll diaphragm compressor 100 can operate without lubrication and/or sliding seals. Some compressor maintenance cycles can be centered around inspection of wear surfaces and management of lubricant. The removal of wear surfaces and/or lubricant in a roll diaphragm compressor can reduce the required maintenance cycle.

In some embodiments, elastomer/fiber composite material used for the roll diaphragm 120 can comprise meridional and/or radial tensile fiber elements with a small degree (for example, less than 10%) of circumferential compliance supplied by an elastomer of the roll diaphragm 120 to allow for the rolling motion of various embodiments. This can be because the primary direction of stress is in the radial direction, and the primary need for elasticity can be in the circumferential direction in some examples.

Vapor compression cycles of various embodiments can be well suited to the use of roll diaphragm compressors 100 as vapor compression cycles can operate at near-ambient temperature in various examples. Accordingly, high strength fibers and elastomers, from which the roll diaphragm 120 may be constructed, can be designed for near ambient temperature operation.

Several compression chambers 130 (each comprised of a roll diaphragm 120 and an interfacing bell-shaped cylinder head 110) can be configured in radial or in-line configurations, in order to improve dynamic balancing and/or to reduce torque ripple and/or bearing loads in some examples.

In some embodiments, a compressor 100 can be directly integrated with a direct drive electric motor so as to reduce bearing number, friction, system volume, and cost. For example, a crank assembly 150 can be directly mounted on an electric motor shaft.

In some embodiments, a roll diaphragm 1020 can be constructed similarly to a power transmission belt or tire, with high strength fiber reinforcement of an elastomer. Although, material selection and construction methods are not limited to conventional power transmission belt and tire materials and construction methods. For example, multiple layer construction can be included in some embodiments, including insulating layers, impermeable layers, and/or protective coatings. A roll diaphragm 120 can also use metallic wires or metallic leafs as the flexible tensile elements in accordance with further embodiments.

A roll diaphragm 120 can be constructed via a molding process. However other construction processes can include, for example, a concentric circle corrugated form constructed from a thin metallic sheet so as to engender axial compliance, with appropriate radial structural support.

In some embodiments, the roll diaphragm 120 does not strictly have to be circular in plan form, for example, elliptical shapes and rectangular shapes with semicircular ends can be present in various examples of a roll diaphragm 120. This can aid in the construction of more compact roll diaphragm compressors 100, and can also reduce circumferential elastomer compliance requirements of various embodiments.

Given that in various embodiments the roll diaphragm compressor 100 does not have piston rings that require a high tolerance lubricated sliding surface cylinder face, alternate materials can be used for the roll diaphragm accompanying housing face 111. For example, polymers and composite materials can be used, as can thin-wall metallic forms constructed in low-precision low-cost manners such as by simple press forming.

Vapor compression cycles can operate at near ambient temperatures. A methanol-water working fluid mixture is one example of a near-ambient-temperature vapor compression cycle. Near-ambient-temperature operation can allow for use of materials that operate at near ambient temperature, for example, composites, polymers, elastomers, and so forth. This can also enable the use of low-cost construction methods associated with some of these materials, for example, injection molding.

In some embodiments, a roll diaphragm compressor 100 can more easily work with two-phase liquid/gas fluids because the roll diaphragm 120 is flexible, reducing susceptibility to hydraulic lock, and because the lack of lubricants can mean that one does not have lubricant washing out problems.

Because the roll diaphragm 120 and interfacing bell-shaped cylinder head 110 can be hermetically sealed in various embodiments, a drive motor for the crank assembly 150 does not need to be part of the hermetic envelope in some examples. In some systems, a diaphragm compressor 100 can comprise both an electric motor and piston in the same hermetic envelope, since the compression chamber itself can leak. By having the electric motor outside the hermetic envelope in some examples, it can be more easily replaced or serviced and does not need to be sold as part of the compressor 100.

Sub-atmospheric pressure vapor compression cycles can use different working fluids. For example: methanol, ethanol, glycerol (antifreeze), water, and mixes of all the above. For example, the cycle depicted in FIG. 3*b* represents a mixture of 85% methanol and 15% water. Some embodiments can include mixtures with 80%-90% methanol; 85%-95% methanol; 70%-90% methanol; 65%-95% methanol, and the like. Some embodiments can include mixtures of 10%-20% water, 5%-25% water, 15%-20% water, 10%-15% water, and the like.

When various pure substances boil or condense, such substances do so at a constant temperature, meaning that a saturated mixture of gas and liquid at equilibrium, if heat is added, can stay at the same temperature until all of the liquid has evaporated into gas. Similarly, a saturated mixture of gas and liquid at equilibrium can stay at the same temperature if heat is removed, until all of the gas has condensed into liquid. This can approximate the thermodynamic process that happens in the condenser and evaporator of a vapor compression cycle using a single-component refrigerant.

Mixtures of water and alcohols (for example, a mixture of 85% methanol and 15% water, as depicted in FIG. 3*b*) where each component has a different boiling point, however, can evaporate or condense at a different temperature depending on the concentration of each component. The concentration of each component can change along the evaporation or boiling process because one substance can preferentially evaporate or condense. This can mean that a vapor compression cycle that uses a soluble mixture of components can have a changing temperature depending on the percent of fluid that has evaporated or condensed.

Figure 3A:
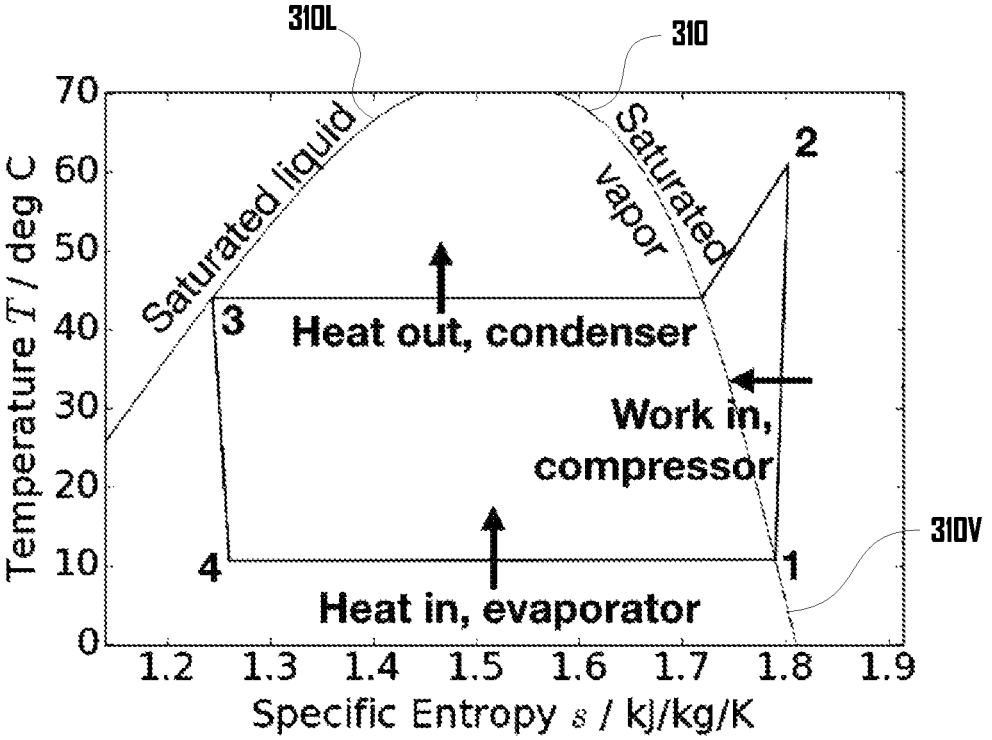
FIG. 3*a* illustrates a temperature-entropy diagram of a vapor compression cycle.
Figure 3B:
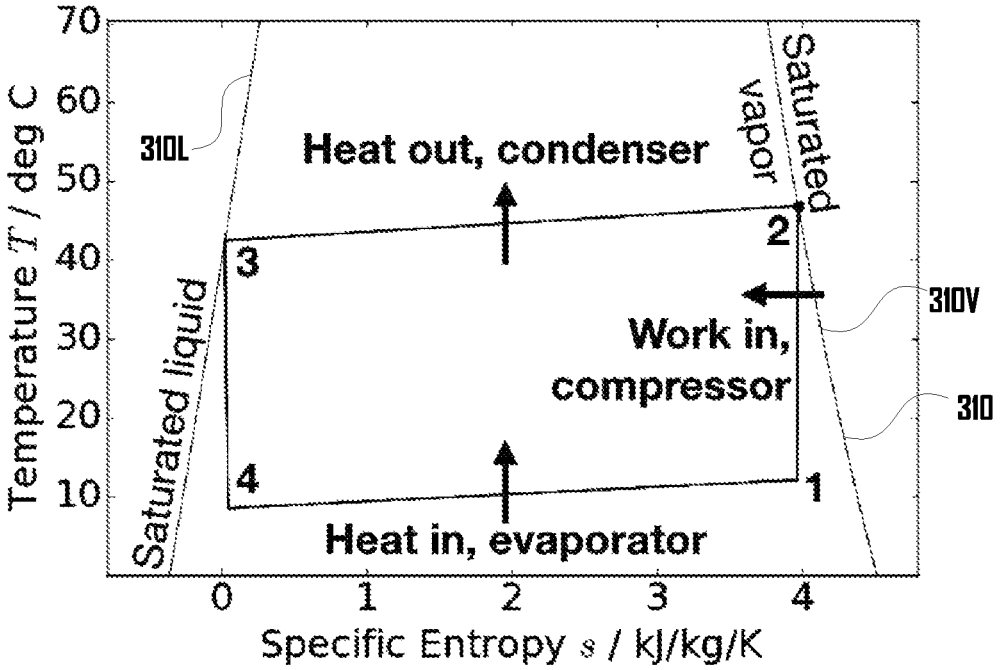
FIG. 3*b* illustrates a vapor compression cycle with wet gas input to the compressor and with a changing evaporation/condensation temperature due to a binary mixture of fluids.

This is depicted in the thermodynamic temperature-entropy diagram of FIG. 3*a*, which illustrates an example temperature-entropy diagram of a vapor compression cycle with a pure (single-component) refrigerant that has a heat removal process in the condenser and a heat addition process in the evaporator that happen at a constant temperature. FIG. 3*b* illustrates a temperature-entropy diagram of a vapor compression cycle with a binary (two-component) refrigerant that has a heat removal process in the condenser and a heat addition process in the evaporator that happen at a non-constant, changing temperature. The non-constant, changing temperature of such examples can be beneficial in various embodiments because the temperature profile can better match the sensible temperature profile of the fluid to or from which heat is transferred in a vapor compression cycle (e.g., air). This can lead to a more efficient cycle in various examples.

In embodiments where a compressor 100 is able to compress fluids which are mixtures of gas and liquid, further improvements to vapor compression cycle efficiency can be possible. The reason for this can be because compressing a gas causes it to heat up, and the amount of temperature which the gas increases can depend on if any evaporation process is taking place concurrently with the compression process. By introducing small amounts of liquid to the inlet 112 of the compressor 100, the gas at the outlet 113 of the compressor 100 can be slightly cooler which can result in a more thermodynamically efficient cycle. For example, in FIG. 3*b*, the fluid entering the compressor is a mixture of 92% vapor by mass and 8% liquid by mass. The result is that the exit of the compressor can be at about 47 degrees C., whereas a comparable cycle using refrigerant R410a with 100% vapor entering the compressor can result in a compressor exit temperature of 60 degrees C. for comparable use cases. This increased temperature in this example is one reason that the efficiency of the cycle using R410a is 18% lower in various examples.

Further examples can include a mixture having 91%-93% vapor by mass; 90%-94% vapor by mass; 89%-95% vapor by mass; 88%-96% vapor by mass; 87%-97% vapor by mass; 90%-92% vapor by mass; 85%-92% vapor by mass; 90%-70% vapor by mass, or the like. Further examples can include a mixture having 7%-9% liquid by mass; 6%-10% liquid by mass; 5%-11% liquid by mass; 4%-12% liquid by mass; 3%-13% liquid by mass; 2%-14% liquid by mass; 1%-15% liquid by mass; 8%-6% liquid by mass; 8%-4% liquid by mass; 8%-10% liquid by mass; 8%-12% liquid by mass, and the like.

This can be seen in FIGS. 3*a* and 3*b*, where the bell-shaped dome on each temperature-entropy diagram can represent the "saturation line" 310, or the point where the substance is either 100% gas at the saturation temperature and pressure, or 100% liquid at the saturation temperature and pressure. The left line 310L is the liquid saturation line and the right line is the vapor (or gas) saturation line 310V. Any point on the diagram to the left of the liquid line 310L is a sub-cooled (or, below saturation temperature) liquid, and any point to the right of the vapor line 310V is a superheated (or, above saturation temperature) gas. Any point between the two lines 310 is a saturated mixture of liquid and gas.

In some compression cycles, the inlet 112 to the compressor 100 is slightly to the right of the vapor saturation line 310V, meaning that the fluid is 100% gas. As a result, the exit 113 of the compressor 100 is superheated by a significant temperature amount. In FIG. 3*b*, the inlet 112 to the compressor 100 can be slightly to the left of the vapor saturation line 310V, meaning small amounts of liquid (in one example, 8%) can exist in the fluid entering the compressor 100. As a result of this, the exit 113 of the compressor 100 can be at the vapor saturation line, which can be a lower temperature than in FIG. 3*a*. The result can be a more efficient thermodynamic cycle. In some examples, this is only possible if the compressor 100 is compatible with small amounts of liquid (in one example, 8%) in the fluid entering the compressor.

Some otherwise relatively efficient vapor compressor types, for example scroll compressors, can have a fixed compression ratio which can reduce their efficiency in operating over a range of pressures and temperatures. One-way-valve-based positive displacement compression can automatically adapt the output pressure ratio to that of the condensers and evaporators, enabling near optimal operation over a broad range of pressures and temperatures in some examples. A roll diaphragm vapor compressor 100 can be a positive displacement compressor that uses valves. In some examples, the compressor 100 can be capable of high efficiency over a broad range of pressures and temperatures.

Variable speed operation can directly control the mass flow rate of the working fluid independently of the pressure ratio. This can allow for direct control of the heating/cooling output of the vapor compression cycle independently of operating pressure ratio/temperature differential.

A sub-atmospheric vapor compression cycle (for example, the cycle in FIG. 3*b* which operates from 1 psia to 5 psia), in various embodiments, can be directly integrated into various suitable heat pump systems, including use with commercially available condensers, evaporators, and throttling valves. Further examples can operate from 1 psia to 3 psia; 1 psia to 7 psia; 1 psia to 9 psia; 1 psia toll psia; 1 psia to 13 psia, less than 14 psia; less than 12 psia; less than 10 psia; less than 8 psia; less than 6 psia; less than 4 psia; less than 2 psia, and the like.

A sub-atmospheric vapor compression cycle can be well suited to operation with secondary heat transfer loops, for example, ground source water loops and hydronic heating/cooling. Operation in conjunction with polymer heat exchangers that favor low pressure water loops can be desirable in some examples.

The depressed freezing point of water-alcohol mixes (antifreeze) can allow a sub-atmospheric vapor compression cycle to operate below the freezing point of water, though icing of external heat exchangers must still be mitigated in various examples, as per air source heat pump systems.

One preferred application of a sub-atmospheric vapor compression cycle is for air conditioning, and ideally, also space heating, in the same combined unit, where the local climate prompts the desire for both capabilities. Such air conditioning units can take the form of window units, central residential systems, commercial units, and industrial systems, for example.

Figure 5:
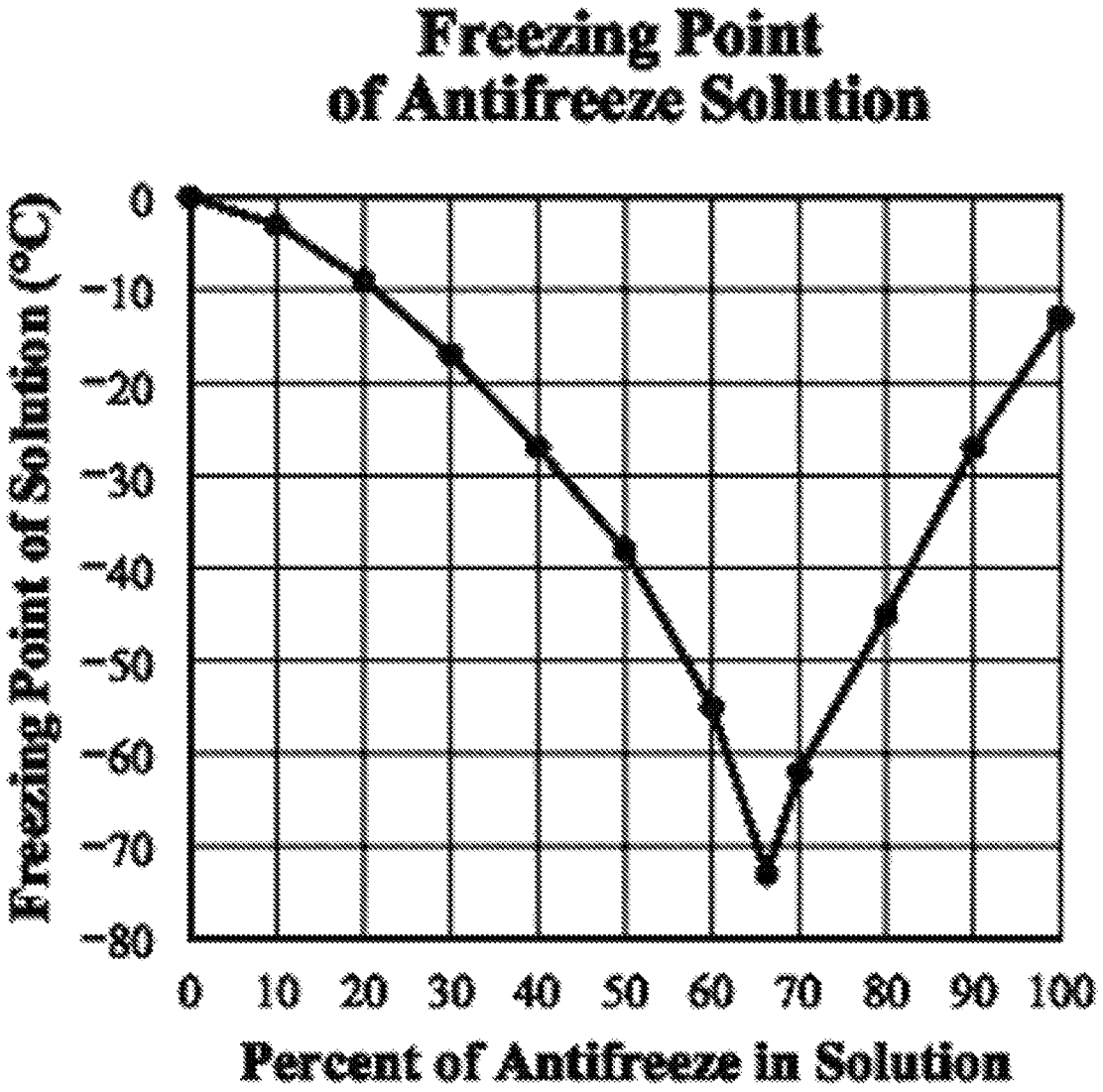
FIG. 5 illustrates the freezing point of an antifreeze/water solution as a function of the percent of antifreeze (e.g., glycol) in the solution.

Alcohol-water mixes can have depressed freezing points, for example antifreeze (ethylene glycol, see FIG. 5). This can enables their use in sub-atmospheric-pressure vapor compression cycles for refrigeration purposes, including below the freezing point of water. Beyond refrigerators, freezers, and general cold chain applications, ice and snow making are also example applications, as are numerous industrial chemical processes.

Given the non-isothermal evaporation and condensation made possible by the working fluid soluble mixture in various embodiments, a vapor compression cycle can be used efficiently for sensible (i.e., heating of a substance which temperature changes as heat is added) heating and cooling. For example, a multistage vapor compression cycle can be constructed for efficient hot water heating using a near-ambient temperature thermal reservoir, such as air, a ground source thermal reservoir, lake, river, sea, and so forth. With multiple condenser steps, each with a temperature gradient such that the output temperature of one step matches the input temperature of the next, it can be possible to smoothly and efficiently heat water from ambient temperature with a minimum of exergy loss.

Figure 6:
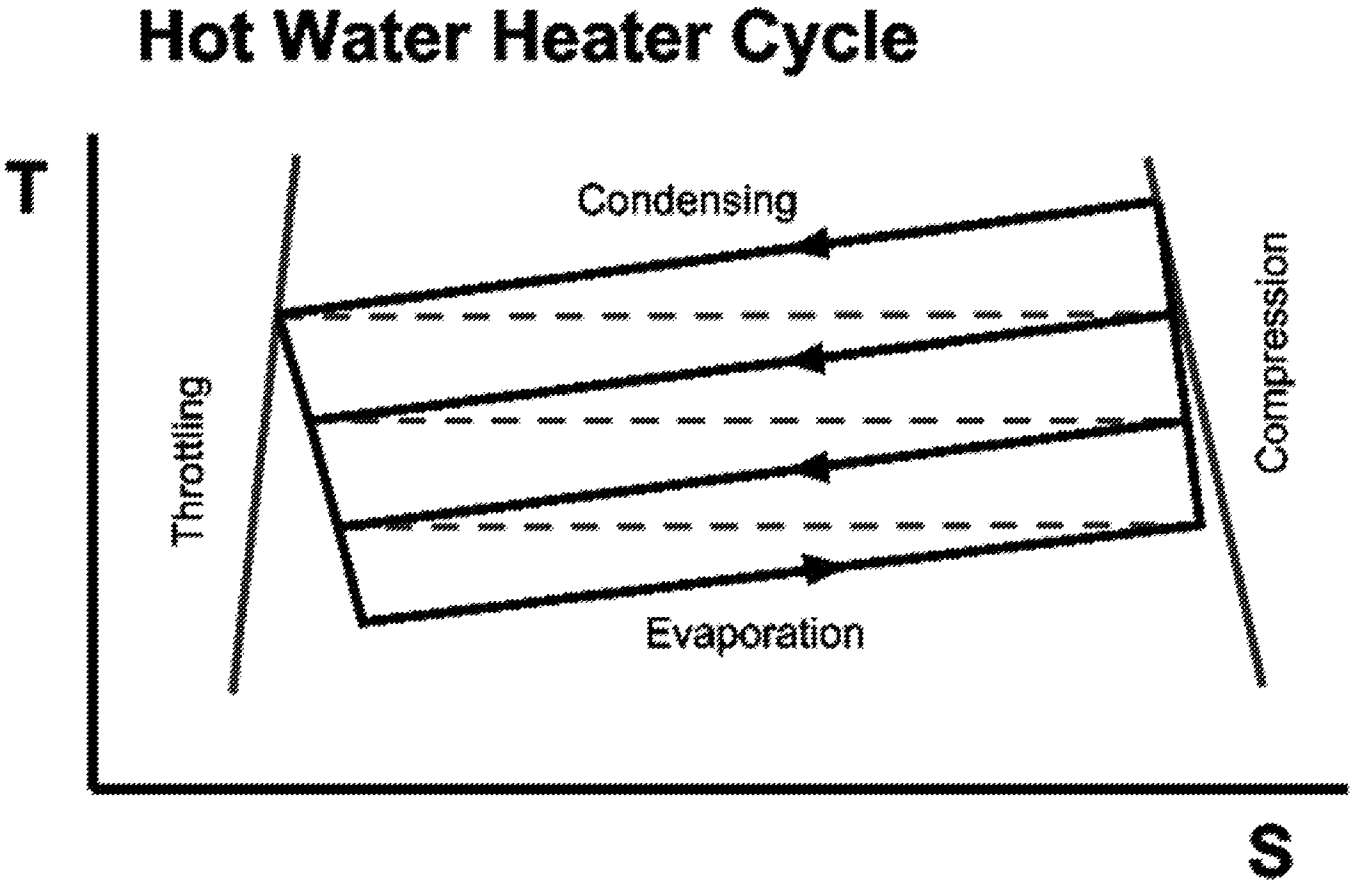
FIG. 6 illustrates a set of cascading vapor compression cycles in a row that can be used to provide heat rejection (from the condenser) over a large varying temperature in accordance with one embodiment.
Figure 7:
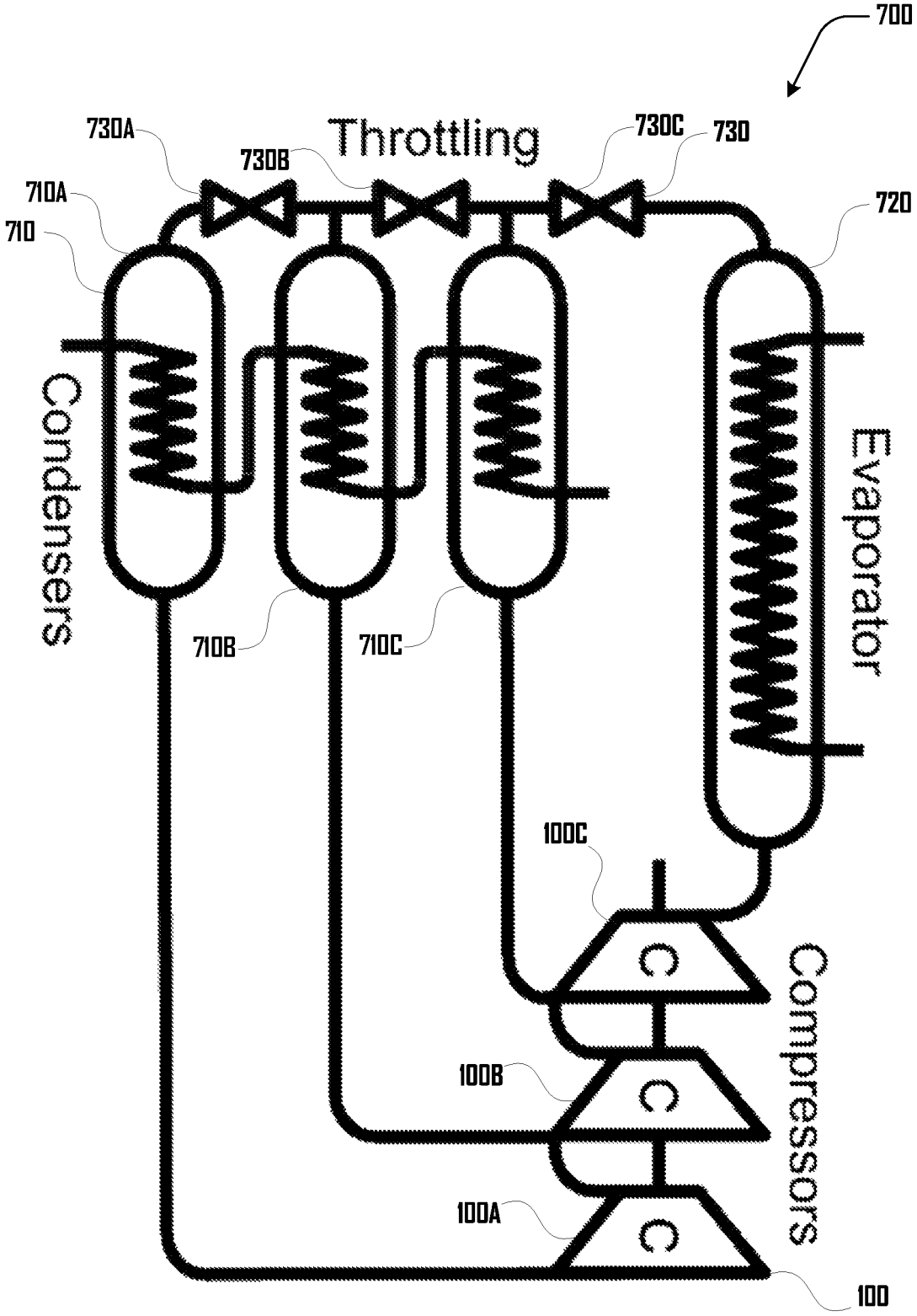
FIG. 7 illustrates a schematic of the components in an example system for generating a cascading vapor compression cycle that can be used to have heat rejection from the condenser over a large range of temperatures, as shown in FIG. 6.

The temperature gradient of the evaporator, which only has a temperature differential corresponding to a single step in various embodiments, can be matched to the near-ambient temperature reservoir (e.g., as in FIGS. 6 and 7).

For example, referring to the system 700 of FIG. 7, fluid can flow through the compressors 100, which can raise the pressure of the fluid. The fluid at higher pressure from the compressor 100 can flow through a respective condenser 710, where the fluid can condense from vapor form to liquid form, giving off heat to a region that is to be heated. More specifically, fluid from a first compressor 100A can flow to a first condenser 710A; fluid from a second compressor 100B can flow to a second condenser 710B; and fluid from a third compressor 100B can flow to a third condenser 710C.

The fluid from the condensers 710 can then go through one or more throttling valves 730, where the fluid experiences a pressure drop. The fluid from the throttling valves 730 can then flow to an evaporator 720, where the fluid draws heat from the evaporator 720 which can cause the fluid to vaporize. For example, fluid from the first condenser 710A can flow through a first, second and third throttling valve 730A, 730B, 730C to the evaporator 720; fluid from the second condenser 710B can flow through the second and third throttling valves 730B, 730C to the evaporator 720; and fluid from the third condenser 710C can flow through the third throttling valve 730C to the evaporator 720. The evaporator 720 can draw heat from a region that is to be cooled. The vaporized fluid can go back to the compressors 100 to restart the cycle.

Each condenser 710 can correspond to a different pressure ratio and the compressors 100 and throttling valves 730 can be tuned to match. For example, the first condenser 710A can correspond to a first pressure ratio and the first compressor 100A can be tuned to match the first pressure ratio; the second condenser 710B can correspond to a second pressure ratio and the second compressor 100B can be tuned to match the second pressure ratio; and the third condenser 710C can correspond to a third pressure ratio and the third compressor 100C can be tuned to match the third pressure ratio. The series of the first, second and third throttling valves 730A, 730B, 730C can be tuned based on the first, second and third pressure ratio. For example, FIG. 6 illustrates one example of three condensing steps tuned to three different pressure ratios, which can be generated by the system 700 of FIG. 7

To this end, in some examples, the compressors 100 comprise, for example, multiple roll diaphragm compressors 100 of differing pressures, volumes and/or time based separation where different compressor strokes are used to pump to different pressures/condensers 710. For example, each of the compressors 100 can operate with the compression chambers 130 having a different maximum operating volume of respective compression cycles of the compressors 100. Additionally, each of the compressors 100 can operate with the compression chambers 130 having a different average operating pressure of respective compression cycles of the compressors 100. Also, each of the compressors 100 can operate with the compression timing of each of the compressors being synchronized at the same frequency, being non-synchronized but staggered at the same frequency, or non-synchronized having different frequencies.

For example, since the pressure in the condenser and evaporator can be set by the temperature of the heat exchanger and the heat transfer rate, because a liquid/vapor mixture at thermodynamic equilibrium can have a pressure of the saturation pressure at the temperature of the heat exchanger, or at least close to it depending on the heat transfer rate and the closeness to thermodynamic equilibrium. In various embodiments, the expansion valve and the compressor speed can be adjusted to ensure that the liquid/vapor mixture is at the right flow rate to evaporate and condense to the desired vapor quality at the exit of the evaporator and condenser, respectively. This can be similar to how standard vapor compression cycles are controlled. The difference can be that the evaporator of one cycle will transfer energy from the condenser of the adjacent cycle, and so on, so that a device can be designed to operate similar to the example shown in FIG. 6.

As for water heating, a vapor compression cycle can be used for sensible heating and cooling as applied to industrial processes. For example, the heating or cooling of fluids. In the case of sensible cooling, multiple sub-ambient temperature (e.g., below 22 degrees C.) evaporator steps can be used in some embodiments instead of above-ambient-temperature (e.g., above 22 degrees C.) condenser steps. In some examples, sub-ambient temperatures can in include below 20, 18, 16, 14, 12, 10, 8, or 6 degrees C., or the like. In some examples, above-ambient-temperature can include above 24, 26, 28, 30, 32, 34, 36, 38, 40, 42, 44, 46, or 28 degrees C., or the like.

Similar to the example vapor compression cycles shown in FIGS. 3, 6 and 7, a similar process can be used for a low-temperature (e.g., below 200 degrees C.) engine. In further examples, low-temperature can include below 20 degrees C., below −200 degrees C., below −20 degrees C., and the like. If heat is added to an evaporator at a higher temperature and heat is removed from a condenser at a lower temperature, and the compressor is replaced with a similar expander, work can be produced. The roll diaphragm engine can also have similar advantages to the roll diaphragm compressor 100, in some embodiments. A sub-atmospheric vapor compression cycle can be used to drive conventional dehumidification systems in various examples.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives.

What is claimed is:

1. A method of operating a system for generating a cascading vapor compression cycle, the method comprising:

performing a cascading vapor compression cycle on a fluid within a system, the system comprising:

a single evaporator, with the system having no more than one evaporator;

a plurality of condensers including a first, second and third condenser that respectively correspond to three different pressure ratios including a first, second and third pressure ratio;

a plurality of compressors including a first, second and third compressor that are respectively tuned differently to match the respective first, second and third pressure ratios of the first, second and third condensers;

a plurality of throttling valves disposed in series including a first, second and third throttling valve that are respectively tuned differently to match the respective first, second and third pressure ratios of the first, second and third condensers; and a plurality of compressor-condenser pairs defined by respective pairs of the plurality of compressors and the plurality of condensers, the compressor-condenser pairs disposed in parallel, wherein the performing the cascading vapor compression cycle on the fluid includes:

only one of the compressors receiving fluid directly from the evaporator, a compressor of each compressor-condenser pair providing fluid to a respective condenser of the compressor-condenser pair, and the condensers providing fluid to the single evaporator via one or more of the plurality of throttling valves where the fluid experiences a pressure drop, with only the third throttling valve directly communicating with the single evaporator, and with each condenser providing fluid to the single evaporator via a different number of throttling valves including:

the first condenser providing fluid to the single evaporator via the first, second and third throttling valves;

the second condenser providing fluid to the single evaporator via the second and third throttling valves from between the first and second throttling valves; and the third condenser providing fluid to the single evaporator via the third throttling valve from between the second and third throttling valves, wherein each compressor of the plurality of compressors comprises a roll-diaphragm compressor that includes:

a rigid compressor head including a bell-shaped interface wall that defines a concave portion, the compressor head further including an apex portion having an inlet port and outlet port;

a circular flexible roll-diaphragm coupled to the compressor head about an edge, and including a central portion that is coupled to and driven by a piston head, the roll-diaphragm driven in a rolling motion against the interface wall; and a compression chamber defined by the compressor head and roll-diaphragm, the compression chamber receiving fluid via the inlet port, compress the fluid based on the volume of the compression chamber being made smaller, and expel the fluid via the outlet port.

2. The method of claim 1, wherein the compressor head and roll-diaphragm of each roll-diaphragm compressor have no sliding seals and use no lubricants.

3. The method of claim 1, wherein the roll-diaphragm is defined by an elastomer-fiber composite material having radial tensile fiber elements disposed within an elastomer, the fiber elements being inextensible along a main axis such that the fiber elements are rigid along their length, with the roll-diaphragm having circumferential compliance of less than 10% that provides for the rolling motion.

4. The method of claim 1, wherein each of the compressor-condenser pairs operate based on different pressure ratios including three compressor-condenser pairs operating respectively based on the first, second and third pressure ratios, including each of the compressors of the three compressor-condenser pairs operating at different average pressures within the compression chambers, with different maximum volumes of the compression chambers, and operating with non-synchronized compression timing based respectively on the first, second and third pressure ratios.

5. A method of performing a vapor compression cycle comprising:

performing a first portion of the vapor compression cycle on a fluid with a plurality of roll-diaphragm compressors that are respectively part of compressor-condenser pairs, the roll-diaphragm compressors including:

a rigid compressor head including a bell-shaped interface wall that defines a concave portion, the compressor head further including an apex portion having an inlet port and outlet port;

a round flexible roll-diaphragm coupled to the compressor head about an edge, and including a central portion that is coupled to and driven by a piston head, the roll-diaphragm driven in a rolling motion against the interface wall; and a compression chamber defined by the compressor head and roll-diaphragm, wherein performing the portion of the vapor compression cycle on the fluid with the roll-diaphragm compressor includes:

the compression chamber receiving a refrigerant via the inlet port in a first state, compressing the refrigerant based on the volume of the compression chamber being made smaller, and expelling the refrigerant in a second state via the outlet port, wherein the roll-diaphragm compressor is configured based at least in part on a pressure ratio of a condenser associated with the roll-diaphragm compressor; and performing a second portion of a vapor compression cycle in a system having a single evaporator and no more than one evaporator, by the plurality of roll-diaphragm compressors respectively providing fluid to a condenser of a compressor-condenser pair, the respective condensers then providing the fluid to the single evaporator via one or more throttling valves, wherein the compressor-condenser pairs operate based on different pressure ratios, including each of the respective compressors operating with one or more of different average pressures within the compression chambers based respectively on one of the different pressure ratios, with different maximum volumes of the compression chambers based respectively on one of the different pressure ratios, and operating with non-synchronized compression timing based respectively on one of the different pressure ratios.

6. The method of performing a vapor compression cycle of claim 5, wherein the roll-diaphragm is defined by an elastomer-fiber composite material having tensile fiber elements disposed within an elastomer.

7. The method of performing a vapor compression cycle of claim 5, wherein performing the portion of the vapor compression cycle on the fluid with the roll-diaphragm compressor includes the compressor head and roll-diaphragm compressing the refrigerant without sliding seals and without lubricants.

8. The method of performing a vapor compression cycle of claim 5 comprising a system for generating a cascading vapor compression cycle, the system comprising:

a plurality of throttling valves disposed in series;

the single evaporator; and the plurality of compressor-condenser pairs of claim 5, the compressor-condenser pairs disposed in parallel with only one of the compressors receiving the refrigerant directly from the single evaporator, a compressor of each compressor-condenser pair providing the refrigerant to a respective condenser of the compressor-condenser pair, the condensers providing the refrigerant to the single evaporator via one or more of the plurality of throttling valves through a single connection between only one of the throttling valves and the single evaporator, with each condenser providing the refrigerant to the single evaporator via a different number of throttling valves.

9. The method of performing a vapor compression cycle claim 8, wherein the plurality of throttling valves disposed in series are respectively configured differently, based on one of the different pressure ratios, to generate different pressure drops in the refrigerant.

10. A method comprising:

performing a first portion of a vapor compression cycle on a fluid with a plurality of roll-diaphragm compressors, the roll-diaphragm compressors including:

a compressor head including an interface wall that defines a concave portion, the compressor head further including an apex portion having an inlet port and outlet port;

a flexible roll-diaphragm coupled to the compressor head about an edge, the roll-diaphragm driven in a rolling motion against the interface wall; and a compression chamber defined by the compressor head and roll-diaphragm, the compression chamber receiving the fluid via the inlet port in a first state, compressing the fluid based on the volume of the compression chamber being made smaller, and expelling the fluid in a second state via the outlet port, wherein the roll-diaphragm compressor is configured based at least in part on a pressure ratio of a condenser associated with the roll-diaphragm compressor; and performing a second portion of the vapor compression cycle in a system having a single evaporator and no more than one evaporator, by the plurality of roll-diaphragm compressors respectively providing fluid to a condenser of a compressor-condenser pair, the respective condensers then providing the fluid to the single evaporator via one or more throttling valves, wherein the compressor-condenser pairs operate based on different pressure ratios, including each of the respective compressors operating with one or more of different average pressures respectively on one of the different pressure ratios, with different maximum volumes of the compression chambers based respectively on one of the different pressure ratios, and operating with non-synchronized compression timing based respectively on one of the different pressure ratios.

11. The method of claim 10, wherein the compression chamber:

receives a refrigerant via the inlet port in the first state comprising liquid and gas;

compresses the refrigerant based on the volume of the compression chamber being made smaller; and expels the refrigerant in a second state via the outlet port.

12. The method of claim 10, wherein the compressor head and roll-diaphragm operate without sliding seals and without lubricants.

13. The method of claim 10, wherein the roll-diaphragm is defined by an elastomer-fiber composite material having tensile fiber elements disposed within an elastomer.

14. The method of claim 10, wherein the compressor head and roll-diaphragm operate without sliding seals, which allows the entirety of the compressor head being used as a valved surface.

15. The method of claim 10, further comprising a plurality of compressor-condenser pairs that each comprise a roll-diaphragm compressor of claim 10 and a condenser, with each of the roll-diaphragm compressors operating with one or more of different average pressures within the compression chambers; different maximum volumes of the compression chambers; and non-synchronized compression timing.

16. The method of claim 15, comprising a system for generating a cascading vapor compression cycle, the system comprising:

a plurality of throttling valves;

the single evaporator; and the plurality of compressor-condenser pairs of claim 15, the compressor-condenser pairs disposed in parallel with at least one of the compressors receiving the fluid from the single evaporator, a compressor of each compressor-condenser pair providing the fluid to a respective condenser of the compressor-condenser pair, and the condensers providing the fluid to the single evaporator via one or more of the plurality of throttling valves.

* * * * *